US008317375B2

(12) United States Patent
Roth

(10) Patent No.: US 8,317,375 B2
(45) Date of Patent: Nov. 27, 2012

(54) ADAPTER FOR OUTDOOR LIGHT

(75) Inventor: Barry Roth, Aventura, FL (US)

(73) Assignee: Megan Roth, North Bay Village, FL (US)

( * ) Notice: Subject to any disclaimer, the term of this patent is extended or adjusted under 35 U.S.C. 154(b) by 719 days.

(21) Appl. No.: 12/574,343

(22) Filed: Oct. 6, 2009

(65) Prior Publication Data

US 2011/0080749 A1 Apr. 7, 2011

(51) Int. Cl.
*F21S 8/00* (2006.01)
*F21S 13/10* (2006.01)

(52) U.S. Cl. ..... 362/431; 362/410; 362/414; 362/448; 248/217.4

(58) Field of Classification Search ..... 362/382–456, 362/152; 248/217.4
See application file for complete search history.

(56) References Cited

U.S. PATENT DOCUMENTS

| | | | | |
|---|---|---|---|---|
| 3,745,331 | A | 7/1973 | Dennis | |
| 2007/0134979 | A1 | 6/2007 | Chen | |
| 2008/0013306 | A1 | 1/2008 | Guilmette | |
| 2009/0021952 | A1 * | 1/2009 | McBride et al. | 362/431 |

FOREIGN PATENT DOCUMENTS

| | | | |
|---|---|---|---|
| KR | 2008019033 | A | 2/2008 |

OTHER PUBLICATIONS

Connection Structure of a street lamp pillar column; Feb. 29, 2008.

* cited by examiner

*Primary Examiner* — Anne Hines
*Assistant Examiner* — Jose M Diaz
(74) *Attorney, Agent, or Firm* — Mark Terry

(57) ABSTRACT

An adapter for an outdoor light is disclosed. The adapter includes a hollow elongated element having a top end and a bottom end and a first opening at the top end of the elongated element, wherein the first opening accepts a shaft of the outdoor light to create a friction fit with the shaft. The adapter further includes a second opening at the bottom end of the elongated element, wherein the second opening includes a tapered interior brim and a plug located at substantially a midpoint of an interior of the elongated element, wherein the plug comprises substantially a disk that contacts an interior surface of the elongated element. The adapter further includes a fastener that extends lengthwise along a centerline of the elongated element, wherein the fastener is coupled at one end to a midpoint of the plug and wherein the fastener protrudes from the second opening of the elongated element.

20 Claims, 7 Drawing Sheets

ADAPTER FOR OUTDOOR LIGHT

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

This invention relates to accessories for outdoor lights, and more particularly to a universal adapter for coupling outdoor lights to various stationary objects.

BACKGROUND OF THE INVENTION

In recent years, outdoor lights have grown in popularity. The vast array of applications for outdoor lights has fueled their increasing sales. Outdoor lights can be used for aesthetic purposes in the design of gardens and yards, as well as for utilitarian purposes such as security, warding of insects or lighting dark paths. Various types of outdoor lights exist. A common type of outdoor light is the solar outdoor light, which consists of a solar element that charges a battery using energy garnered from a solar panel, a light emitting mechanism 102 (see FIG. 1) such as one or more LEDs, a base portion 104 comprising a shaft and a sharp stake 106 for inserting into the ground, wherein the stake is coupled to the base portion. Multiple outdoor solar lights can be placed along the foot of a garden path, for example, to light the way in the evening when there is no ambient light. Another common type of outdoor light is the electric outdoor light, which is similar to the solar outdoor light except that the electric outdoor light is connected to a power source via a power cord. Multiple outdoor electric lights can be strung together along the power cord to provide light to an outdoor area.

One problem that users of outdoor lights often encounter is the lack of options available when it comes to the location where an outdoor light is affixed. Since conventional outdoor lights usually come with a base portion that comprises a sharp stake for driving into the ground, users are limited to soft ground for the placement of outdoor lights. A sharp stake does not allow an outdoor light to be placed on hard ground, such as rocky terrain that does not allow a stake to be driven into it. Further, a sharp stake does not allow an outdoor light to be placed on a hard stationary object such as a fence post, a dock piling, a tree or any other stationary object comprised of a hard material that does not accept a sharp stake. This can be problematic to users of outdoor lights since soft ground is not always available in an outdoor area a user desires to illuminate. Furthermore, illuminating an outdoor area at ground level is not always desirable. At times, users desire to light up an outdoor area by placing outdoor lights at shoulder level or higher. This is not possible with the currently-available outdoor lights since they only allow for ground-level placement of the lights.

Therefore, a need exists to overcome the problems with the prior art as discussed above, and particularly for an apparatus that allows conventional outdoor lights to be coupled with various stationary objects.

SUMMARY OF THE INVENTION

Briefly, in accordance with one embodiment of the present invention, an adapter for an outdoor light is disclosed. The adapter includes a hollow elongated element having a top end and a bottom end and a first opening at the top end of the elongated element, wherein the first opening accepts a shaft of the outdoor light to create a friction fit with the shaft. The adapter further includes a second opening at the bottom end of the elongated element, wherein the second opening includes a tapered interior brim and a plug located at substantially a midpoint of an interior of the elongated element, wherein the plug comprises substantially a disk that contacts an interior surface of the elongated element. The adapter further includes a fastener that extends lengthwise along a centerline of the elongated element, wherein the fastener is coupled at one end to a midpoint of the plug and wherein the fastener protrudes from the second opening of the elongated element.

In another embodiment of the present invention, an assembly for coupling an outdoor light to a stationary object is disclosed. The assembly includes a light emitting mechanism and a base portion of the light emitting mechanism comprising a cylindrical shaft. The assembly further includes a tubular element having a top end and a bottom end and a first opening at the top end of the tubular element, wherein the first opening accepts the shaft of the base portion to create a friction fit with the shaft. The assembly further includes a second opening at the bottom end of the tubular element, wherein the second opening includes a tapered interior brim and a plug located at substantially a midpoint of an interior of the tubular element, wherein the plug comprises substantially a disk that contacts an interior surface of the tubular element. The assembly further includes a screw that extends lengthwise along a centerline of the tubular element, wherein the screw is coupled at one end to a midpoint of the plug and wherein the screw protrudes from the second opening of the tubular element.

In another embodiment of the present invention, an assembly for coupling an outdoor light to a stationary object is disclosed. The assembly includes a cover for covering a top end of a post and a tubular element having a top end and a bottom end. The assembly further includes a first opening at the top end of the tubular element, wherein the first opening accepts a shaft of an outdoor light to create a friction fit with the shaft and a second opening at the bottom end of the tubular element, wherein the second opening includes a tapered interior brim. The assembly further includes a plug located at substantially a midpoint of an interior of the tubular element, wherein the plug comprises substantially a disk that contacts an interior surface of the tubular element and a fastener that extends lengthwise along a centerline of the tubular element, wherein the fastener is coupled at one end to a midpoint of the plug and wherein the fastener protrudes from the second opening of the tubular element and is coupled to a top of the cover.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

Figure 1:
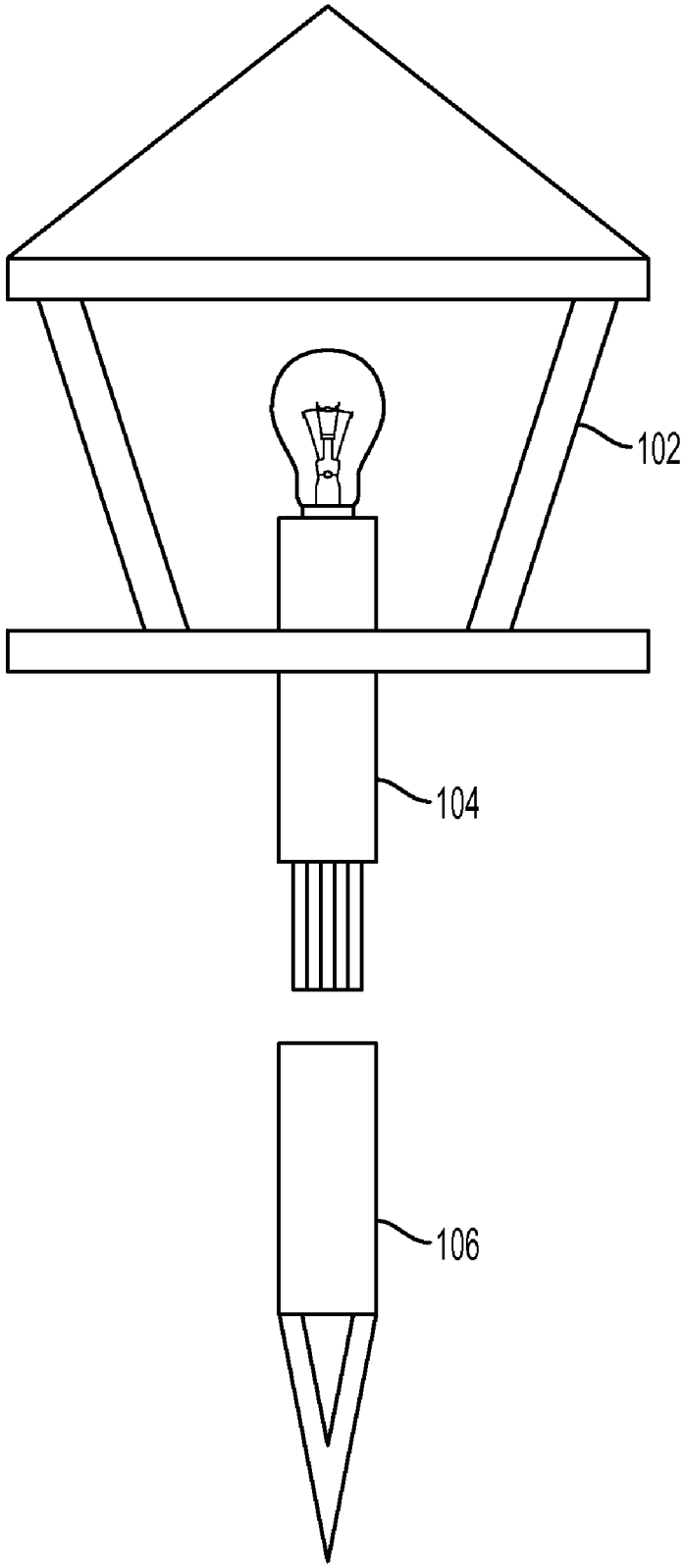
FIG. 1 PRIOR ART
FIG. 1 is an illustration of a frontal view of a prior art outdoor light.

It should be understood that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality. In the drawing like numerals refer to like parts through several views.

The present invention, according to a preferred embodiment, overcomes problems with the prior art by providing a universal adapter for securely coupling commercially available outdoor lights to stationary objects such as fence posts or dock pilings. The present invention further solves problems with the prior art by providing an adapter apparatus that provides a snug and secure fit between the apparatus and the stationary object, even in cases where the stationary object does not comprise a flat surface but may include a protruding or sloping surface. Further, the present invention solves problems with the prior art by providing an adapter apparatus that fits various types of outdoor lights while also fitting various types of stationary objects, thereby providing a universal apparatus that can be used with a variety of outdoor lights and stationary objects.

Figure 2:
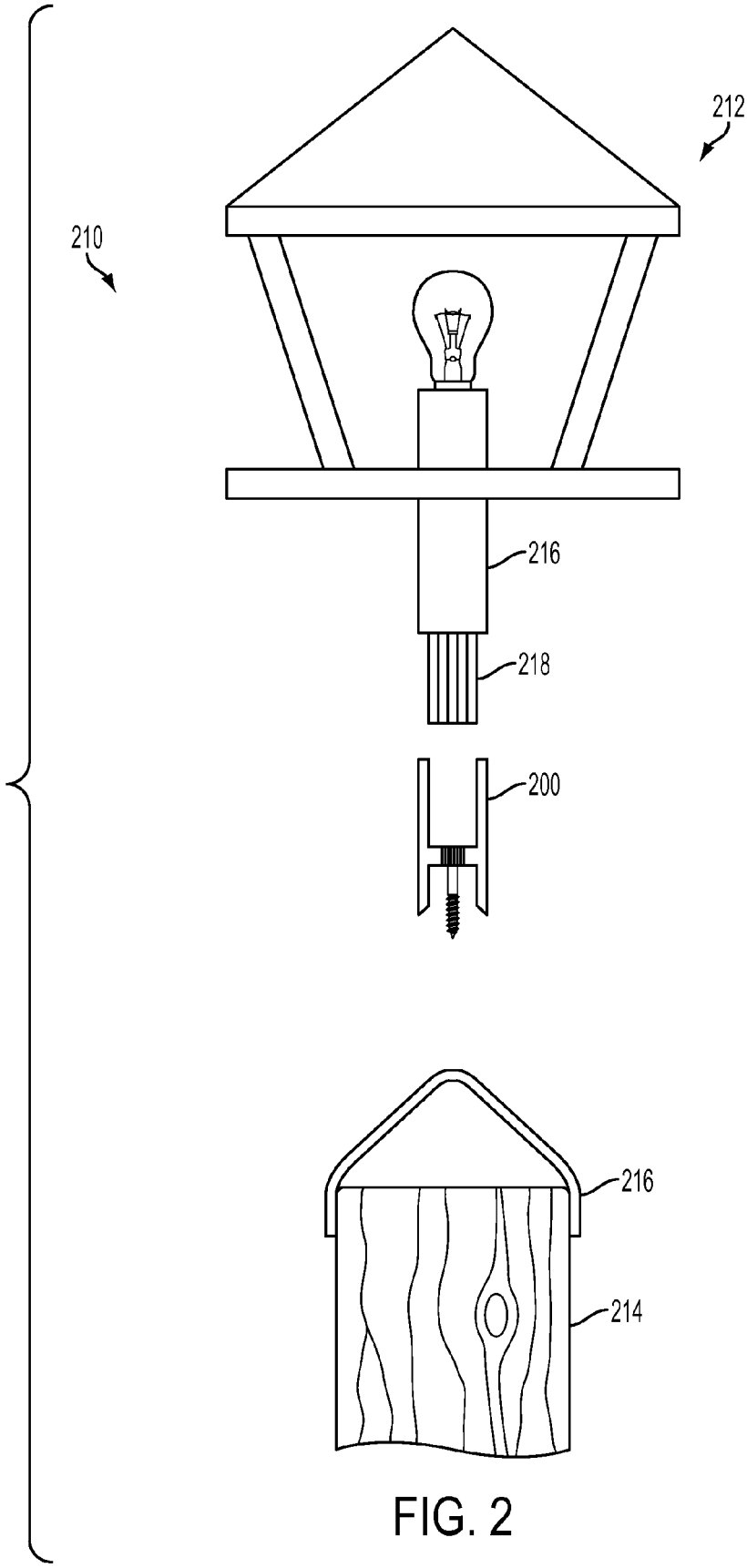
FIG. 2 is an illustration of a frontal view, including a partial cross section, of an assembly for coupling an outdoor light to a stationary object, in accordance with one embodiment of the present invention.

FIG. 2 is an illustration of a frontal view, including a partial cross section, of an assembly 210 for coupling an outdoor light 212 to a stationary object 214, in accordance with one embodiment of the present invention. FIG. 2 shows an outdoor light 212 including a base portion 216 and a cylindrical shaft 218. The outdoor light 212 may comprise a solar outdoor light powered via a battery that is charged by a solar panel. Alternatively, outdoor light 212 may be an electric outdoor light that is powered via a wire that is coupled to a power outlet.

FIG. 2 also shows a post 214, such as a fence post, a pile or a dock piling, wherein the post 214 may be cylindrical, rectangular or any other shape. Also shown is a cover 216 that covers the top end of the post. The cover 216 can serve decorative purposes but may also serve utilitarian purposes such as deterring animals, i.e., birds, from sitting on top of the post and damaging the post via animal droppings. Further, the cover 216 may be comprised of a plastic material, a rubber material or a metallic material. FIG. 2 further shows the universal adapter 200 for securely coupling the light 212 to the stationary object, post 214. Greater detail about universal adapter 200 is provided with reference to the figures below.

Figure 3:
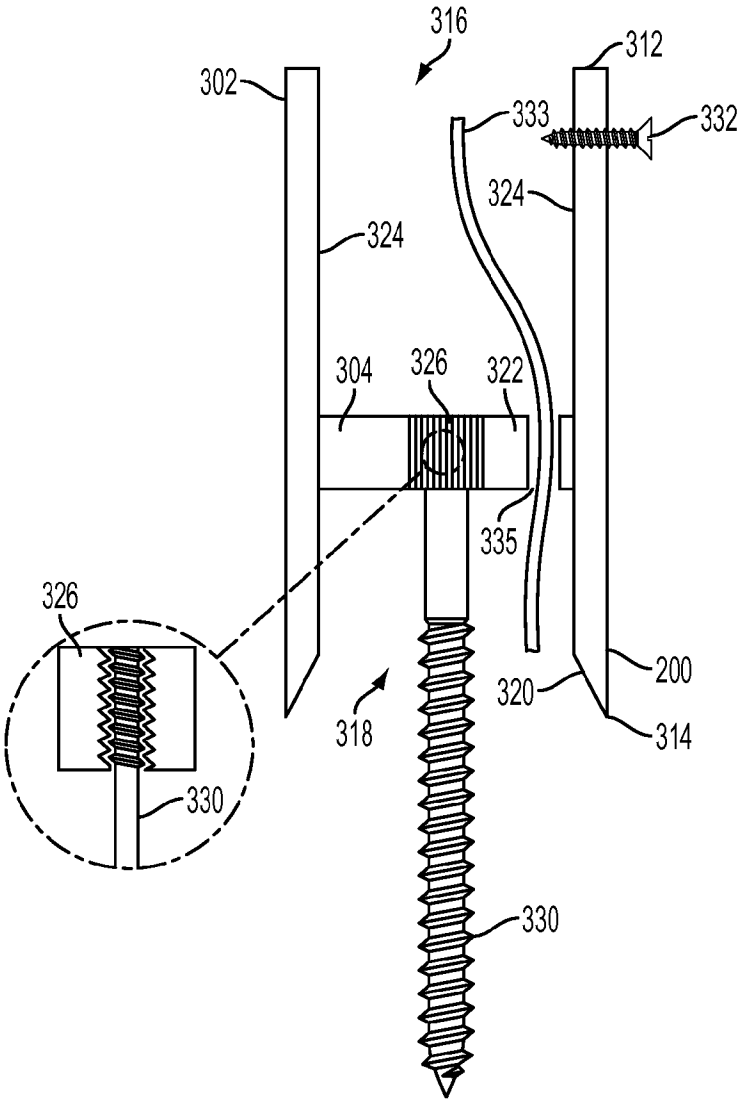
FIG. 3 is an illustration of a cross sectional view of the universal adapter of FIG. 2 for coupling an outdoor light to a stationary object, in accordance with one embodiment of the present invention.

FIG. 3 is an illustration of a cross sectional view of the universal adapter 200 of FIG. 2 for coupling an outdoor light 212 to a stationary object 214, in accordance with one embodiment of the present invention. FIG. 3 shows that adapter 200 includes a hollow tubular elongated element 302 having a top end 312 and a bottom end 314. A first opening 316 at the top end 312 of the elongated element 302, accepts a shaft 218 of an outdoor light 212 to create a friction fit with the shaft 218. A second opening 318 at the bottom end 314 of the elongated element 302 includes a tapered interior brim 320, wherein the edge of the brim forms an acute angle.

FIG. 3 further shows a plug 322 located at substantially a midpoint of an interior of the elongated element 302, wherein the plug 322 comprises substantially a disk that contacts an interior surface 324 of the elongated element 302. In one embodiment, the plug 322 may be integrally formed with the tubular element 302. Also shown is a sleeve 326 located at the midpoint of the plug 322, wherein the sleeve 326 includes a threaded interior surface that accepts the top end of a screw 330. The inset image of FIG. 3 shows greater detail about the threaded interior surface of the sleeve 326 and the threaded exterior surface of the top end of screw 330. The screw 330 extends lengthwise along a centerline of the elongated element 302, wherein the screw 330 is coupled at its top end to a midpoint of the plug 322 at the sleeve 326 and wherein the screw 330 protrudes from the second opening 318 of the elongated element 302.

FIG. 3 further shows a set screw 332 located near the top end 312 of the elongated element 302, wherein the set screw 332 secures the shaft 218 to the elongated element 302 when the shaft is inserted into the elongated element 302 and the set screw 332 is tightened so as to further penetrate the elongated element 302.

Also shown in FIG. 3 is a cross section of an orifice 335 in plug 322. The orifice 335 allows a power wire 333 to be threaded through the orifice 335 so as to access the bottom portion 314 of element 302. This is shown and explained in greater detail with reference to FIG. 8 below. In one embodiment of the present invention, elements 302 and 322 can be formed as one integral part. In another embodiment, elements 302, 322 are formed as two separate and substantially equal halves (wherein the device of FIG. 3 is split in two halves with a vertical separation extending down the middle of the device). In this embodiment, the two halves of the device of FIG. 3 are coupled using tabs or another fastening apparatus. This embodiment may be useful if the vertical separation extends through the orifice 335, such that the wire 333 may be threaded through the orifice 335 before the two halves of the device of FIG. 3 are coupled.

Figure 4:
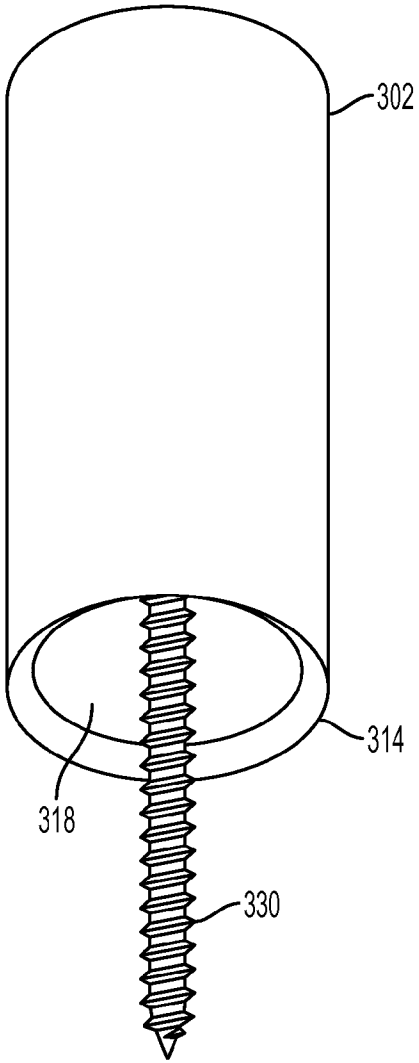
FIG. 4 is an illustration of a perspective view of the universal adapter of FIG. 2 for coupling an outdoor light to a stationary object, in accordance with one embodiment of the present invention.

FIG. 4 is an illustration of a perspective view of the universal adapter 200 of FIG. 2 for coupling an outdoor light 212 to a stationary object 214, in accordance with one embodiment of the present invention. FIG. 4 shows the tubular element 302 and second opening 318 at the bottom end 314 of the tubular element 302, wherein the screw 330 protrudes out of the second opening 318.

Figure 5:
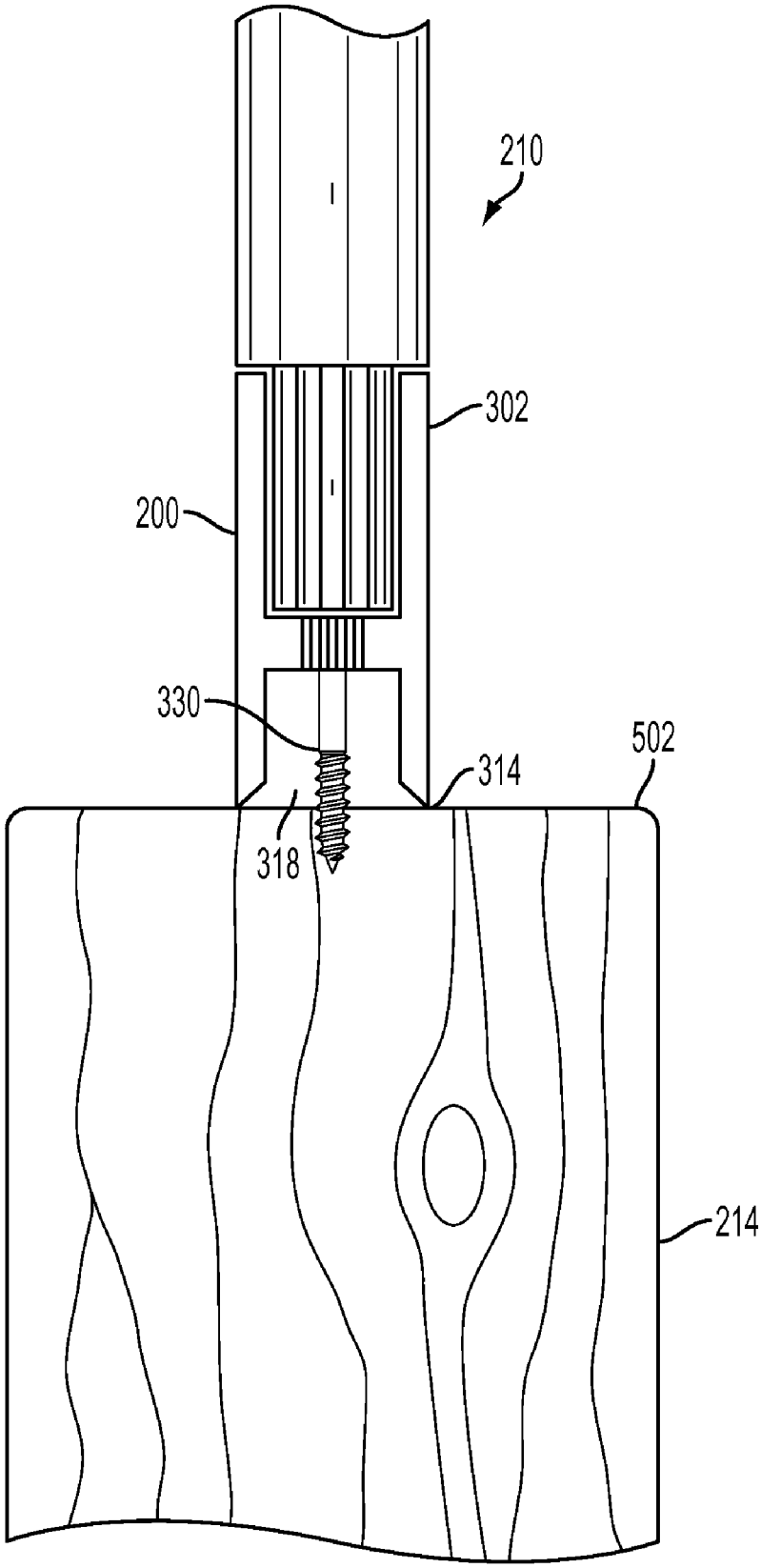
FIG. 5 is an illustration of a frontal view, including a partial cross section, of the assembly for coupling an outdoor light to a post, in accordance with one embodiment of the present invention.

FIG. 5 is an illustration of a frontal view, including a partial cross section, of the assembly 210 for coupling an outdoor light 212 to a post 214, in accordance with one embodiment of the present invention. FIG. 5 shows that the screw 330 protrudes out of the second opening 318 of the tubular element 302 and that the screw 330 is driven into the flat top face 502 of the post 214 so as to securely couple the element 302 to the post 214. Note there is no gap between the bottom end 314 of the element 302 and the top face 502 of the post 214. Thusly, the entire circumference of the circular bottom end 314 of the element 302 contacts the top face 502 of the post 214, thereby producing a secure connection between the adapter 200 and the post 214. By extension, a secure connection thereby exists between the light 212 and the post 214.

Figure 6:
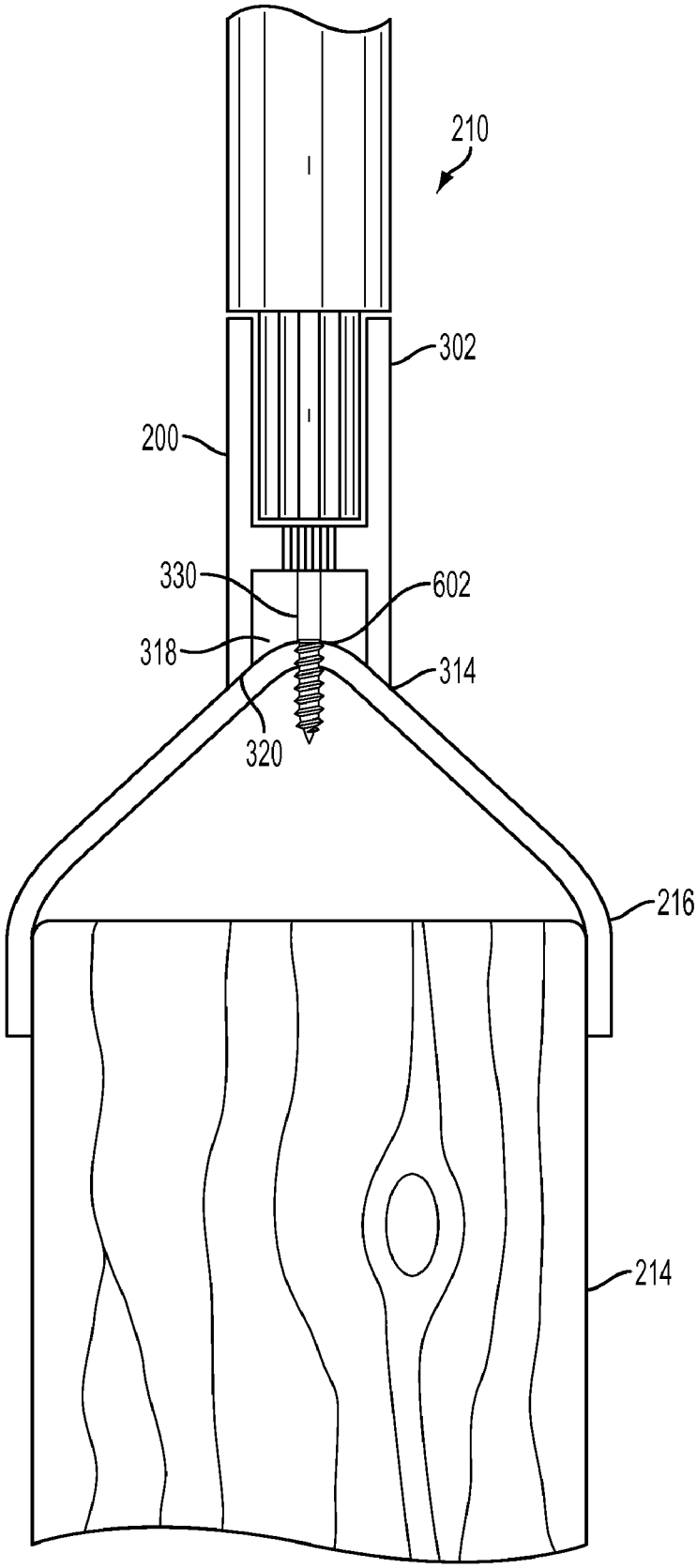
FIG. 6 is an illustration of a frontal view, including a partial cross section, of the assembly for coupling an outdoor light to a post cover, in accordance with one embodiment of the present invention.

FIG. 6 is an illustration of a frontal view, including a partial cross section, of the assembly 210 for coupling an outdoor light 212 to a post cover 216, in accordance with one embodiment of the present invention. FIG. 6 shows that the screw 330 protrudes out of the second opening 318 of the tubular element 302 and that the screw 330 is driven into the dome-like top 602 of the cover 216 so as to securely couple the element 302 to the cover 216. Note there is no gap between the bottom end 314 of the element 302 and the dome-like top 602 of the cover 216. This is due to the tapered inside brim 320 of the second opening 318. Thusly, the entire circumference of the circular bottom end 314 of the element 302 contacts the dome-like top 602 of the cover 216, thereby producing a secure connection between the adapter 200 and the cover 216. By extension, a secure connection thereby exists between the light 212 and the post 214.

Figure 7:
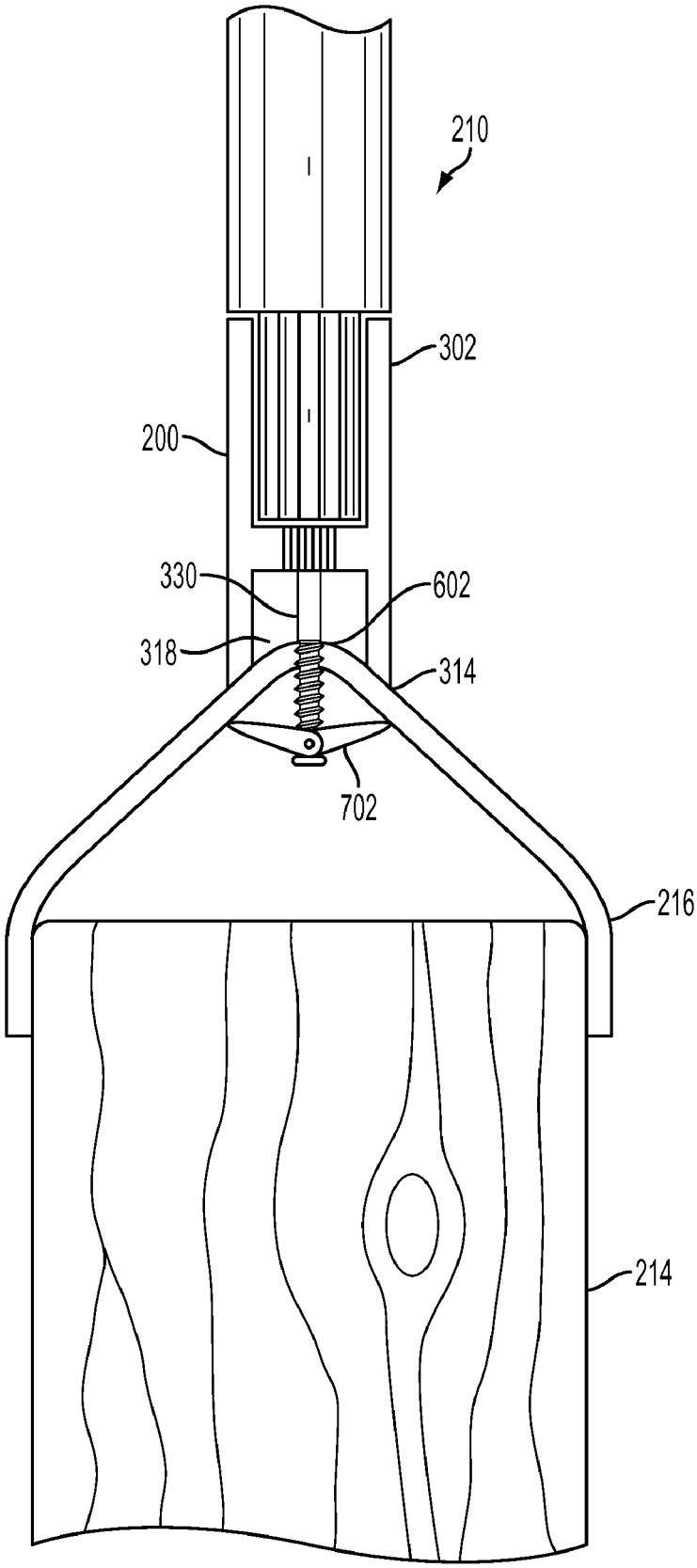
FIG. 7 is an illustration of a frontal view, including a partial cross section, of the assembly for coupling an outdoor light to a post cover with an expansion element, in accordance with one embodiment of the present invention.

FIG. 7 is an illustration of a frontal view, including a partial cross section, of the assembly 210 for coupling an outdoor light 212 to a post cover 216 with an expansion element 702, in accordance with one embodiment of the present invention. FIG. 7 shows that the screw 330 protrudes out of the second opening 318 of the tubular element 302 and that the screw 330 is driven into the dome-like top 602 of the cover 216. At the bottom end of the screw 330 is an expansion element 702 comprising one or more wings or flanges that pivot around a center-point and flare outwards so as to expand when the screw 330 is pulled out or upwards. This prevents the screw 330 from being easily removed from the top of the cover 216. Thus, the element 302 is securely coupled to the cover 216.

Figure 8:
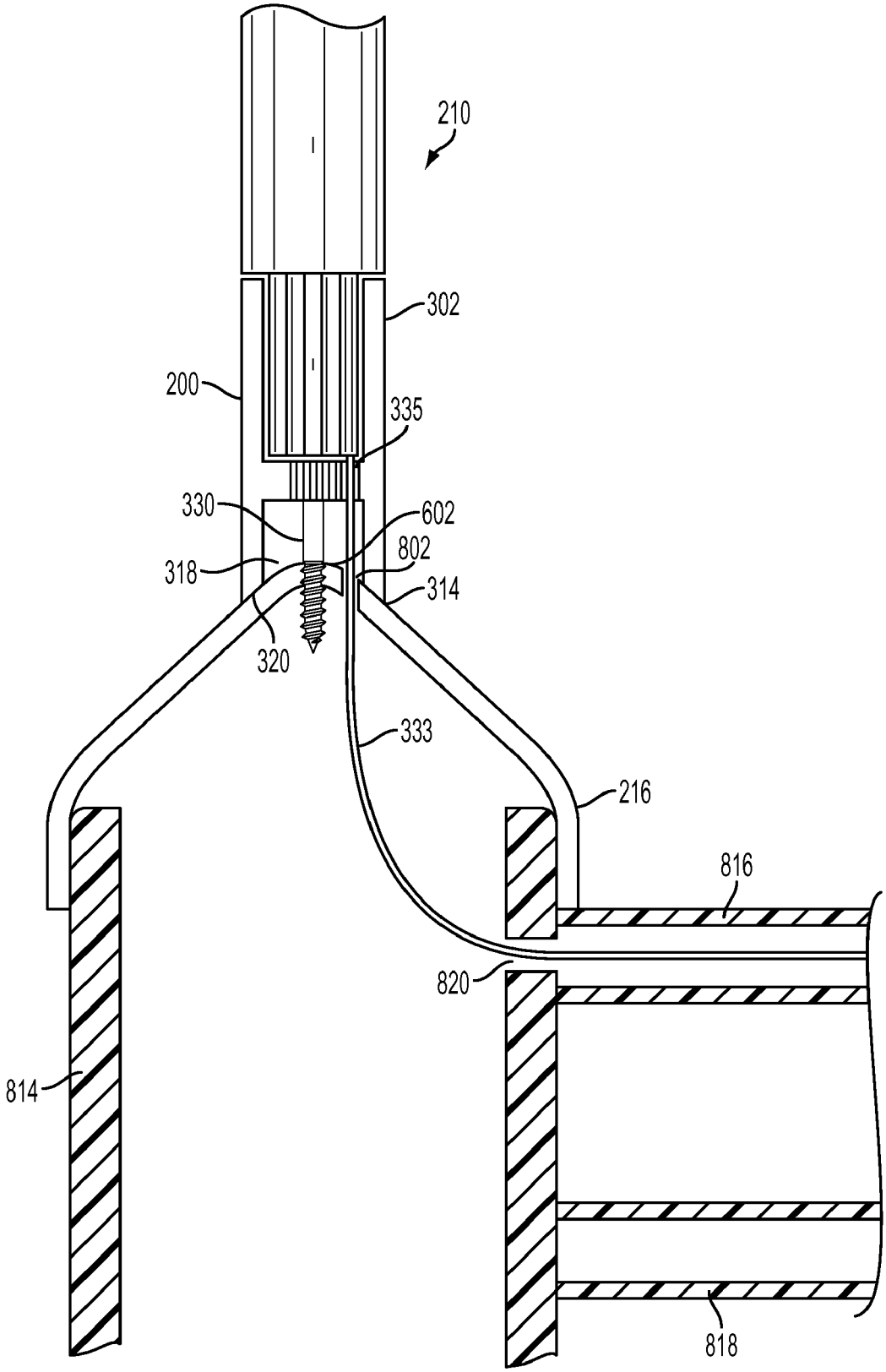
FIG. 8 is an illustration of a frontal view, including a partial cross section, of an alternative assembly for coupling an outdoor light to a hollow post cover, in accordance with one embodiment of the present invention.

FIG. 8 is an illustration of a frontal view, including a partial cross section, of an alternative assembly for coupling an outdoor light 212 to a hollow post cover 216, in accordance with one embodiment of the present invention. Note that FIG. 8 shows a hollow post cover 216, a hollow vertical gate post 814 and two hollow horizontal gate elements 816 and 818. The post 814 and gate elements 816 and 818 may comprise hollow plastic gating, such as hollow PVC gating.

FIG. 8 shows that the screw 330 protrudes out of the second opening 318 of the tubular element 302 and that the screw 330 is driven into the dome-like top 602 of the cover 216. FIG. 8 further shows that an electrical wire 333 originating from the outdoor light 212 is threaded through orifice 335 in plug 322 and further through orifice 802 in post cover 216. Subsequently, the wire 333 is threaded through the hollow post 814, through an orifice 820 in the side of post 814 and further into the hollow horizontal gate element 816. In this manner, the wire 333, which provides electric power to the light 212 and which also may provide power to other outdoor light elements, may be hidden from view within the cavities in adapter 200, post cover 216 and gate elements 814 and 816. The hidden quality of the wire 333 is desirable for protection of the wire and also for aesthetic purposes.

Elements 302 and 304 may be manufactured from a variety of materials including metal, such as stainless steel, titanium, aluminum or any metal alloy, rigid fabric, carbon fiber, epoxy resin, graphite, rubber, plastic or any combination of the above.

Plastic covers a range of synthetic or semi-synthetic polymerization products. Plastics are composed of organic condensation or addition polymers and may contain other substances to improve performance or economics. In the present invention, plastic may comprise any one of the following forms of plastic: polyethylene, polystyrene, high impact polystyrene, polyethylene terephthalate, nylon, polypropylene, acrylonitrile butadiene styrene (ABS), bayblend and polyvinylidene chloride (PVC).

Elements 302 and 304 may be manufactured of the present invention can be manufactured from a plastic compound using any variety of processes, such as injection molding, fusible core injection molding and thermoforming.

Injection molding is a manufacturing technique for making parts from thermoplastic material in production. Molten plastic is injected at high pressure into a mold, which is the inverse of the produces shape. After a product is designed by an industrial designer, molds are made by a mold-maker from metal, usually either steel or aluminum, and precision-machined to form the features of the desired part. Injection molding is widely used for manufacturing a variety of parts and is the most common method of plastic production.

The most commonly used thermoplastic materials are polystyrene, ABS or acrylonitrile butadiene styrene, nylon, polypropylene, polyethylene, and polyvinyl chloride or PVC.

Injection molding machines, also known as presses, hold the molds in which the components are shaped. Presses are rated by tonnage, which expresses the amount of clamping force that the machine can generate. This pressure keeps the mould closed during the injection process.

Molds separate into at least two halves (called the core and the cavity) to permit the plastic part to be extracted. In general, the shape of a part must not cause it to be locked into the mould. For example, sides of objects typically cannot be parallel with the direction of draw (the direction in which the core and cavity separate from each other). They are angled slightly. Pins are the most popular method of removal from the core, but air ejection, and stripper plates can also be used depending on the application. Most ejection plates are found on the moving half of the tool, but they can be placed on the fixed half.

Molds are built through two main methods: standard machining and EDM machining. Standard machining, in its conventional form, has historically been the method of building injection molds. With technological development, computer numerical control (CNC) machining became the predominant means of making more complex molds with more accurate mold details in less time than traditional methods.

The electrical discharge machining (EDM) or spark erosion process has become widely used in mold making. EDM is a simple process in which a shaped electrode, usually made of copper or graphite, is very slowly lowered onto the mould surface (over a period of many hours), which is immersed in paraffin oil. A voltage applied between tool and mould causes erosion of the mould surface in the inverse shape of the electrode.

Fusible core injection molding or lost core injection molding is a specialized plastic injection molding process. It is used in the manufacture of molded components with cavities or undercuts, which would not be possible with tools having demoldable cores. The process consists of three essential steps. First, a core consisting of a low melting point metal is poured in the shape of the cavity specified for the molded component. This is inserted into the injection mold in the second step and injected with plastic. Molded component and core are both demolded and, in the third step, immersed in a heated bath to melt out the core. The bath temperature is selected to be somewhat higher than that of the core alloy's melting point, but not so that the injected part would be damaged. Induction heating of the core metal in the heated bath reduces the melt out time to a few minutes. Liquid core metal collects on the bottom of the heated bath and is usable for a new core.

Thermoforming is a manufacturing process for thermoplastic sheet or film. The sheet or film is heated between infrared, natural gas, or other heaters to its forming temperature. Then it is stretched over or into a temperature-controlled, single-surface mold. Cast or machined aluminum is the most common mold material, although epoxy and wood tooling are sometime used for low volume production. The sheet is held against the mold surface unit until cooled. The formed part is then trimmed from the sheet. The trimmed material is usually reground, mixed with virgin plastic, and reprocessed into a usable sheet. There are several categories of thermoforming, including vacuum forming, pressure forming, twin-sheet forming, drape forming, free blowing, and simple sheet bending.

In one embodiment of the present invention, elements 302, 304 may be manufactured from a material that dissipates or insulates the heat created by the accompanying outdoor light during use. The material used to manufacture the elements 302, 304, such as plastic, may possess heat isolative properties that prevent the exterior of apparatus 200 from overheating. Alternatively, the material used to manufacture the elements 302, 304, such as metal, may possess heat conductive properties that quickly dissipate the heat originating from the light mechanism. Alternatively, the material used to manufacture the elements 302, 304 may possess any combination of heat insulating and heat conducting properties so as to accomplish the goal of re-directing the heat emanating from the light mechanism so as not to harm humans or animals that may contact the apparatus. Such redirection of the laptop heat is beneficial as it reduces or eliminates the negative implications of high temperatures that may harm living organisms including animals and plant life.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

I claim:

1. An adapter for an outdoor light, comprising:

a hollow elongated element having a top end and a bottom end;

a first opening at the top end of the elongated element, wherein the first opening accepts a shaft of the outdoor light to create a friction fit with the shaft;

a second opening at the bottom end of the elongated element, wherein the second opening includes a tapered interior brim;

a plug located at substantially a midpoint of an interior of the elongated element, wherein the plug comprises substantially a disk that contacts an interior surface of the elongated element; and a fastener that extends lengthwise along a centerline of the elongated element, wherein the fastener is coupled at one end to a midpoint of the plug and wherein the fastener protrudes from the second opening of the elongated element.

2. The adapter of claim 1, wherein the hollow elongated element comprises a tube having a circular-shaped cross section.

3. The adapter of claim 2, wherein the first opening is a circular-shaped opening.

4. The adapter of claim 3, wherein the second opening is a circular-shaped opening and wherein the tapered interior brim creates an acute angle.

5. The adapter of claim 4, wherein the fastener comprises a screw coupled at a top end to the midpoint of the plug and wherein the screw protrudes from the second opening of the elongated element.

6. The adapter of claim 5, further comprising a sleeve located at the midpoint of the plug, wherein the sleeve includes a threaded interior surface that accepts the top end of the screw.

7. The adapter of claim 4, wherein the fastener comprises an expansion bolt coupled at a top end to the midpoint of the plug and wherein the expansion bolt protrudes from the second opening of the elongated element.

8. An assembly for coupling an outdoor light to a stationary object, comprising:

a light emitting mechanism;

a base portion of the light emitting mechanism comprising a cylindrical shaft;

a tubular element having a top end and a bottom end;

a first opening at the top end of the tubular element, wherein the first opening accepts the shaft of the base portion to create a friction fit with the shaft;

a second opening at the bottom end of the tubular element, wherein the second opening includes a tapered interior brim;

a plug located at substantially a midpoint of an interior of the tubular element, wherein the plug comprises substantially a disk that contacts an interior surface of the tubular element; and a screw that extends lengthwise along a centerline of the tubular element, wherein the screw is coupled at one end to a midpoint of the plug and wherein the screw protrudes from the second opening of the tubular element.

9. The assembly of claim 8, further comprising:

a wire coupled to a power outlet, wherein the light emitting mechanism is powered by a current provided via the wire.

10. The assembly of claim 9, further comprising:

a cutout located at the top end of the tubular element, wherein the wire is threaded through the cutout.

11. The assembly of claim 10, further comprising:

a set screw located near the top end of the tubular element, wherein the set screw secures the shaft to the tubular element.

12. The assembly of claim 8, further comprising:

a solar panel for charging a battery that powers the light emitting mechanism.

13. The assembly of claim 12, further comprising a sleeve located at the midpoint of the plug, wherein the sleeve includes a threaded interior surface that accepts the top end of the screw.

14. The assembly of claim 13, wherein the screw includes an expansion element located at a bottom end of the screw.

15. An assembly for coupling an outdoor light to a stationary object, comprising:

a cover for covering a top end of a post;

a tubular element having a top end and a bottom end;

a first opening at the top end of the tubular element, wherein the first opening accepts a shaft of an outdoor light to create a friction fit with the shaft;

a second opening at the bottom end of the tubular element, wherein the second opening includes a tapered interior brim;

a plug located at substantially a midpoint of an interior of the tubular element, wherein the plug comprises substantially a disk that contacts an interior surface of the tubular element; and a fastener that extends lengthwise along a centerline of the tubular element, wherein the fastener is coupled at one end to a midpoint of the plug and wherein the fastener protrudes from the second opening of the tubular element and is coupled to a top of the cover.

16. The assembly of claim 15, wherein the cover comprises a plastic circular element that fits around a top end of a post.

17. The assembly of claim 15, wherein the cover comprises a metallic square element that fits around a top end of a post.

18. The assembly of claim 15, wherein the fastener comprises a screw coupled at a top end to the midpoint of the plug and wherein the screw protrudes from the second opening of the elongated element.

19. The assembly of claim 18, further comprising a sleeve located at the midpoint of the plug, wherein the sleeve includes a threaded interior surface that accepts the top end of the screw.

20. The assembly of claim 15, wherein the fastener comprises an expansion bolt coupled at a top end to the midpoint of the plug and wherein the expansion bolt protrudes from the second opening of the elongated element.

* * * * *